US007235919B2

(12) United States Patent
Ha

(10) Patent No.: US 7,235,919 B2
(45) Date of Patent: Jun. 26, 2007

(54) ELECTRON EMISSION DEVICE WITH ELECTRON EMISSION REGION ON CATHODE ELECTRODE WITH GATE ELECTRODE ARRANGED TO FOCUS ELECTRONS EMITTED FROM THE ELECTRON EMISSION REGION

(75) Inventor: Jae-Sang Ha, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/067,246

(22) Filed: Feb. 24, 2005

(65) Prior Publication Data

US 2005/0184649 A1 Aug. 25, 2005

(30) Foreign Application Priority Data

Feb. 25, 2004 (KR) ..... 10-2004-0012631

(51) Int. Cl.
*H01J 1/62* (2006.01)
*H01J 63/04* (2006.01)

(52) U.S. Cl. ..... 313/495; 313/496; 313/497; 313/311

(58) Field of Classification Search ..... 313/497, 313/496, 495, 309–311
See application file for complete search history.

(56) References Cited

U.S. PATENT DOCUMENTS 5,982,091 A * 11/1999 Konishi ..... 313/495
6,621,232 B2 * 9/2003 Jo et al. ..... 315/169.3
2004/0251813 A1 * 12/2004 Okai et al. ..... 313/495
2005/0067938 A1 * 3/2005 Sheu et al. ..... 313/311

* cited by examiner

*Primary Examiner*—Mariceli Santiago
(74) *Attorney, Agent, or Firm*—Christie, Parker & Hale, LLP

(57) ABSTRACT

An electron emission device includes a cathode substrate and an anode substrate facing each other that are separated from each other by a predetermined distance to form a vacuum vessel. An electron emission unit is disposed on the cathode substrate to emit electrons, and a light emission unit is disposed on the anode substrate to emit light caused by the electrons for displaying desired images. In more detail, a gate electrode is arranged on the cathode substrate to correspond to the center of a pixel area of the electron emission device, a cathode electrode is arranged on an outer portion of the gate electrode while insulated from the gate electrode, and an electron emission region is arranged on the cathode electrode.

20 Claims, 4 Drawing Sheets

ELECTRON EMISSION DEVICE WITH ELECTRON EMISSION REGION ON CATHODE ELECTRODE WITH GATE ELECTRODE ARRANGED TO FOCUS ELECTRONS EMITTED FROM THE ELECTRON EMISSION REGION

CROSS REFERENCE TO RELATED APPLICATION

This application claims priority to and the benefit of Korean Patent Application No. 10-2004-0012631 filed on Feb. 25, 2004 in the Korean Intellectual Property Office, the entire content of which is incorporated herein by reference.

FIELD OF THE INVENTION

The present invention relates to an electron emission device, and in particular, to elements of an electron emission unit for an electron emission device.

BACKGROUND OF THE INVENTION

Generally, electron emission devices can be classified into two types. In the first type, a hot (or thermoionic) cathode is used as an electron emission source. In the second type, a cold cathode is used as an electron emission source.

Known electron emission devices of the second type include a field emitter array (FEA) type, a surface conduction emitter (SCE) type, a metal-insulator-metal (MIM) type, a metal-insulator-semiconductor (MIS) type, and a ballistic electron surface emitting (BSE) type.

Although, electron emission devices differ in specific structure depending on their types, each electron emission device generally includes an electron emission unit contained within a vacuum vessel and an image display unit facing the electron emission unit in the vacuum vessel.

In an FEA type electron emission device, electrons are emitted from electron emission regions of an electron emission unit by electric fields formed when driving voltages are applied to driving electrodes located in the electron emission regions.

In the case that the FEA type electron emission device has a tri-electrodes system comprised of a cathode electrode, a gate electrode, and an anode electrode, it generally has a structure in which the cathode electrode is formed on a first substrate, a electron emission region is formed on the cathode electrode, and the gate electrode is formed over the cathode electrode interposing an insulating layer to expose the electron emission region. Each of the insulating layer and the gate electrode has a respective hole to expose the electron emission region.

However, in the electron emission device with the structure mentioned above, an electron beam emitted from the electron emission region through the gate electrode to the anode electrode does not always reach a desired phosphor layer and may be scattered around the gate electrode. As such, the electron beam may collide with an undesired phosphor layer to reduce color representation. To put it another way, in a conventional electron emission device, there is a problem in properly focusing the electron beam. To solve this problem, an electron emission device has been suggested which has an electrode for focusing the electron beam provided on a gate electrode, but the satisfactory focusing has not yet been achieved.

SUMMARY OF THE INVENTION

In an aspect of the present invention, an electron emission device is provided which improves focusing capacity of the electron beam emitted from an electron emission region.

According to one embodiment of the present invention, an electron emission device includes a cathode substrate and an anode substrate facing each other and separated from each other by a predetermined distance to form a vacuum vessel, an electron emission unit disposed on the cathode substrate to emit electrons, and a light emission unit disposed on the anode substrate to emit light caused by the electrons for displaying desired images. The electron emission unit includes a gate electrode, a cathode electrode, and an electron emission region. The gate electrode is arranged on the cathode substrate to correspond to the center of a pixel area of the electron emission device, the cathode electrode is arranged on an outer portion of the gate electrode and insulated from the gate electrode, and the electron emission region is arranged on the cathode electrode.

According to one embodiment of the present invention, an electron emission device includes a cathode substrate and an anode substrate facing each other, a gate electrode arranged on the cathode substrate, a cathode electrode arranged around the gate electrode and being symmetric with respect to the gate electrode, and an electron emission region arranged on the cathode electrode.

The gate electrode and the cathode electrode can be insulated by an insulating layer formed on the cathode substrate, and the cathode electrode can be formed on the insulating layer.

The insulating layer can have an insulating layer hole to expose a part of the gate electrode. The insulating layer hole can be formed in a linear pattern.

The gate electrode can have a single layer structure, or a multiple layer structure having two or more layers.

Moreover, the insulating layer hole can be formed in a dot (or circular) pattern.

According to one embodiment of the present invention, an electron emission device includes a cathode substrate and an anode substrate facing each other; an insulating layer formed on the cathode substrate; a cathode electrode formed on the insulating layer and having a portion arranged on a plane; a gate electrode formed on the cathode substrate having a portion exposed through the insulating layer and arranged on the plane of the cathode electrode, the gate electrode being insulated from the cathode electrode by the insulating layer; and an electron emission region formed on the cathode electrode.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, exemplary embodiments of the present invention are shown and described by way of illustration. Accordingly, the drawings and description are to be regarded as illustrative in nature, and not restrictive.

Figure 1:
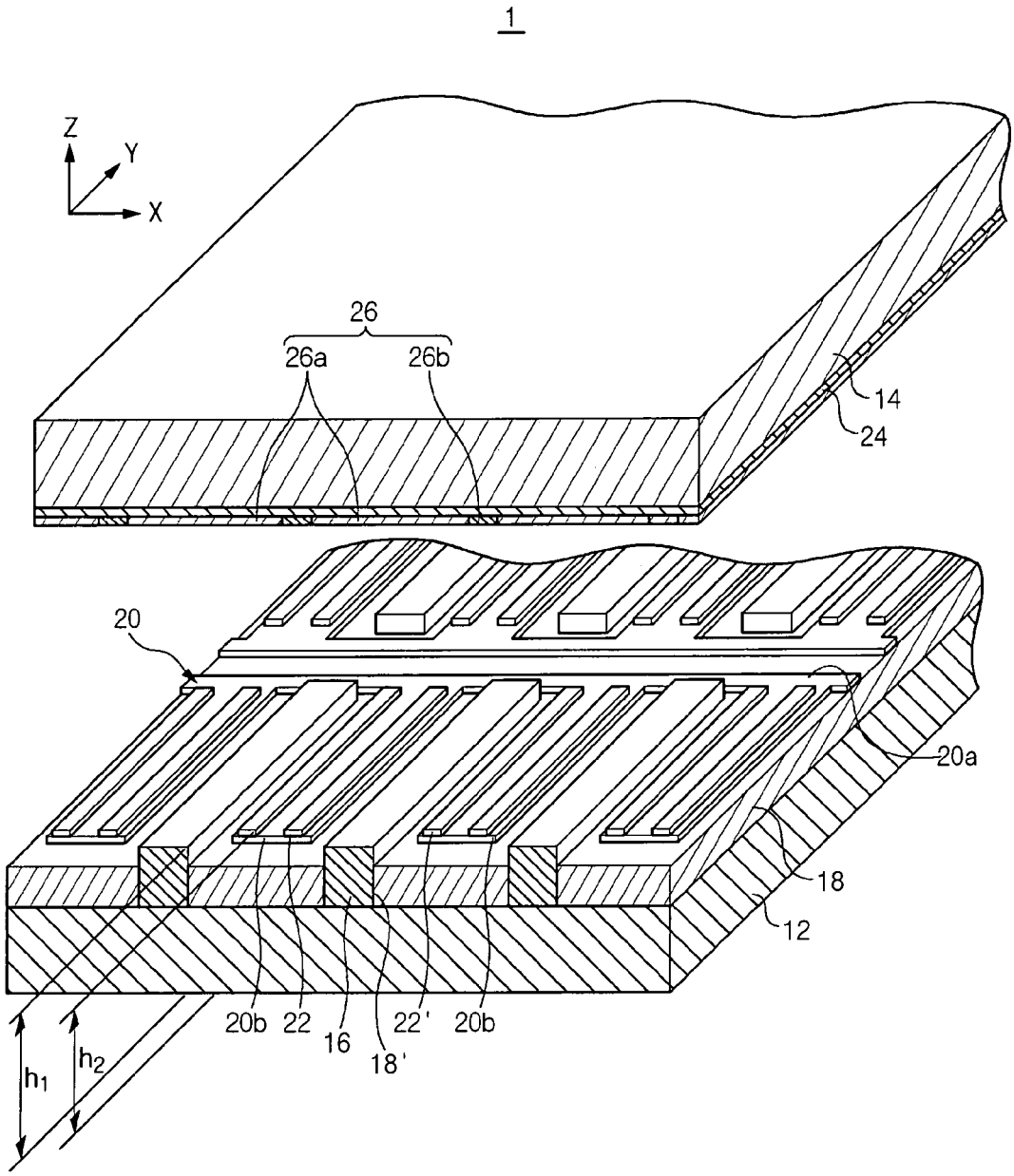
FIG. 1 is a partial exploded perspective view of an electron emission device according to a first embodiment of the present invention.

FIG. 1 is a partial exploded perspective view of an electron emission device 1 according to a first embodiment of the present invention. The electron emission device 1 can be a field emitter array (FEA) type electron emission device.

As shown in FIG. 1, the electron emission device 1 includes a cathode substrate 12 and an anode substrate 14 facing each other and separated from each other by a predetermined distance to form a vacuum vessel. An electron emission unit is disposed on the cathode substrate 12 to emit electrons, and a light emission unit is disposed on the anode substrate 14 to emit light caused by the electrons emitted from the electron emission unit for displaying desired images.

In more detail, a plurality of gate electrodes 16 are arranged on the cathode substrate 12 along a first direction (e.g., in a direction of an arrow Y of FIG. 1), and are spaced apart at a predetermined distance. The gate electrodes 16 are formed by a thick layer process, and each of the gate electrodes 16 positioned on the cathode substrate 12 can correspond to the center of a pixel area of the electron emission device 1.

An insulating layer 18 is formed around the gate electrodes 16. The insulating layer 18 has an insulating layer hole 18' formed in a linear pattern to expose at least a part of the gate electrodes 16. A plurality of cathode electrodes 20 are arranged on the insulating layer 18 along a second direction (e.g., a direction of an arrow X of FIG. 1) intersecting the first direction of the gate electrodes 16, and being spaced apart at a predetermined distance. In one embodiment, the gate electrodes 16 can have a portion arranged on the same plane as the cathode electrodes 20.

The cathode electrodes 20 can each include a line portion 20*a* linearly disposed along the second direction, and an extension portion 20*b* extended from the line portion 20*a* and disposed between the gate electrodes 16.

Electron emission regions 22, 22' comprised of electron emission material are disposed on each of the extension portions 20*b*.

The cathode electrodes 20 and the electron emission regions 22, 22' have a structure such that they surround a gate electrode 16. Moreover, a cathode electrode 20 has a symmetric shape (left-right symmetry in the drawing) with respect to a gate electrode 16.

A height of a gate electrode 16, that is, the height ($h_1$) from a bottom surface of the cathode substrate 12 to a top surface of the gate electrode 16 can be adjusted according to the driving conditions. In the first embodiment, the height ($h_1$) is set to be larger than a height ($h_2$) from the bottom surface of the cathode substrate 12 to a top surface of the electron emission regions 22, 22'.

The electron emission regions 22, 22' may include one or more carbonaceous materials, such as carbon nanotube, graphite, diamond, diamond-like carbon, and/or $C_{60}$ (fullerene) materials. In one embodiment, carbon nanotubes are adopted as the electron emission regions 22, 22'.

Alternatively, the electron emission regions 22, 22' may include nanometer-sized materials, such as carbon nanotube, graphite nanofiber, and/or silicon nanowire materials.

The electron emission regions 22, 22' of the first embodiment are flat in shape, but they may take various other shapes.

In addition, an anode electrode 24 is disposed on one surface of the anode substrate 14 facing the cathode substrate 12, and one surface of the anode electrode 24 has a phosphor screen 26 including red, green, and blue phosphor layers 26*a* and black layers 26*b* positioned between the phosphor layers 26*a*.

Figure 2:
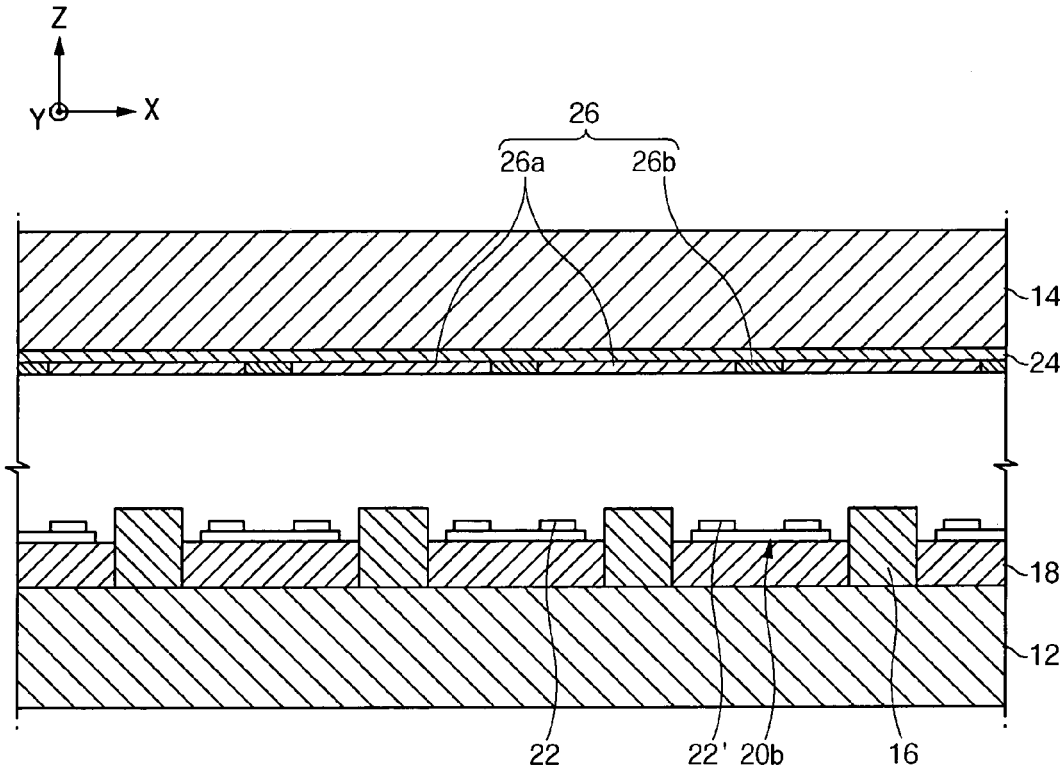
FIG. 2 is a partial assembled cross-sectional view of the electron emission device according to FIG. 1, which is taken in a direction of an arrow Y of FIG. 1.

In the electron emission device 1 and referring also to FIG. 2, a gate electrode 16 is disposed between an electron emission region 22 on a first extension portion 20*b* and an electron emission region 22' on a second extension portion 20*b*, and a higher voltage is applied to the gate electrode 16 than is applied to the cathode electrode 20. Accordingly, when driving voltages for the cathode electrodes 20, the gate electrodes 16, and the anode electrode 24 are applied, electrons emitted from the electron emission regions 22, 22' can be deflected (or focused) toward the center of a pixel by the electric field formed by the gate electrodes 16, and thereby collide with the proper phosphor layers 26*a* of the corresponding phosphor screen 26. Therefore, the electron emission device 1 can display the desired images with good quality while efficiently preventing spreading of the electron beam, and enhancing color representation.

Figure 3:
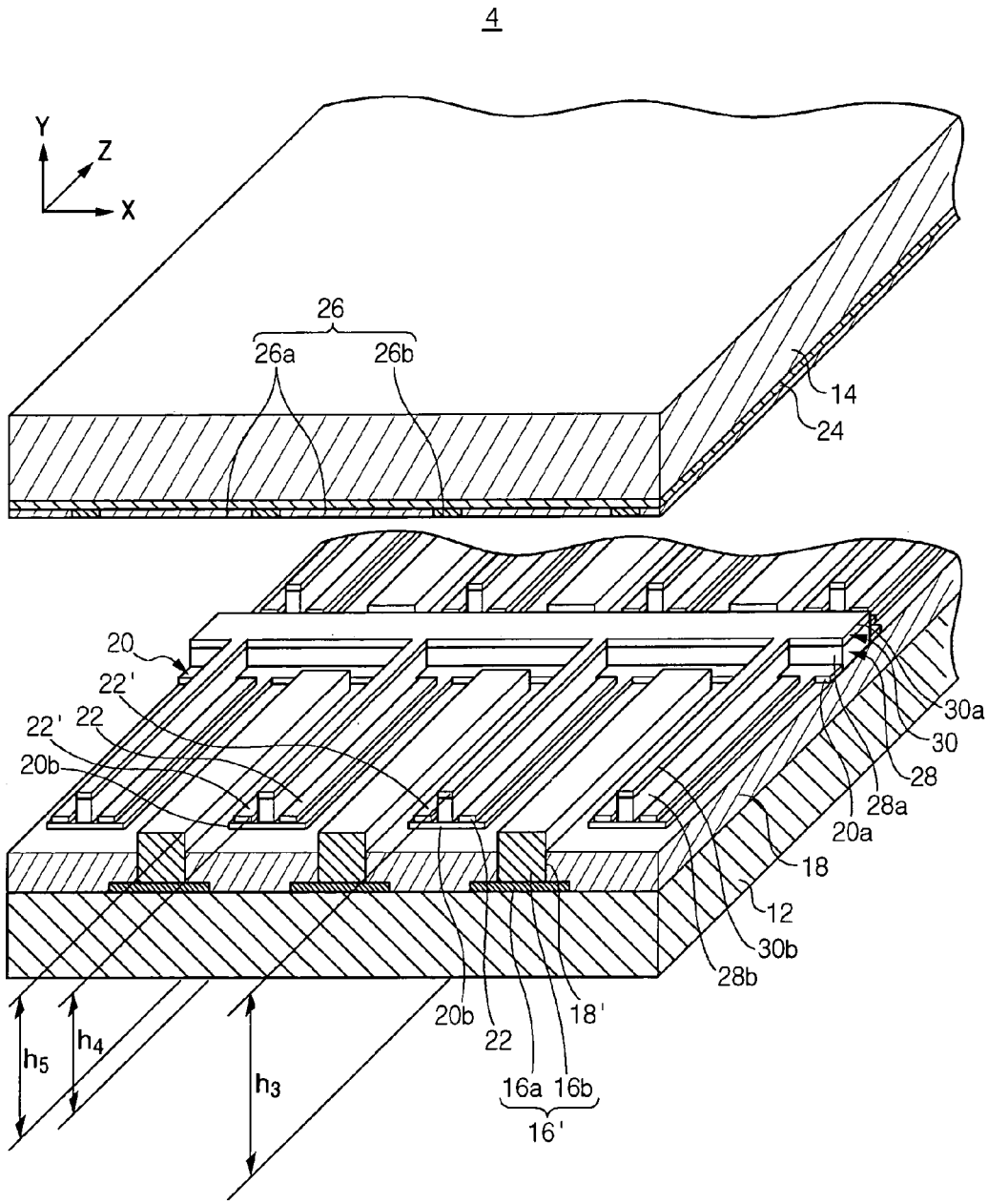
FIG. 3 is a partial exploded perspective view of an electron emission device according to a second embodiment of the present invention.

FIG. 3 is a schematic exploded perspective view of an electron emission device 4 according to a second embodiment of the present invention.

Certain differences of the second embodiment from the first embodiment described in FIG. 1 and FIG. 2 are in that the second embodiment further includes a control electrode 30 to minimize spreading of an electron beam, and each of its gate electrodes 16' includes a first gate electrode 16*a* having a thin layer and a second gate electrode 16*b* having a thick layer. The thick layer of the second electrode 16*b* is thicker than the thin layer of the first gate electrode 16*a*.

In more detail, a cathode substrate 12 has gate electrodes 16', an insulating layer 18, cathode electrodes 20, and electron emission regions 22, 22'. A gate electrode 16' includes a first gate electrode 16*a* having a thin layer formed in a stripe pattern, and a second gate electrode 16*b* having a thick layer formed in a linear pattern on the first gate electrode 16*a*.

A pair of the electron emission regions 22, 22' are formed on an extension portion 20*b* of a cathode electrode 20. Further, an additional insulating layer 28 is formed on the cathode electrode 20, and a control electrode 30 is formed on the additional insulating layer 28 to accelerate or focus electrons emitted from the electron emission regions 22, 22'.

The pattern of the additional insulating layer 28 and the control electrode 30 corresponds to the pattern of the cathode electrode 20. That is, the additional insulating layer 28 and the control electrode 30 have respective line portions 28*a*, 30*a* (corresponding to the line portion 20*a* of the cathode electrode 20) and extension portions 28*b*, 30*b* (corresponding to the extension portion 20*b* of the cathode electrode 20) extended from the line portions 28*a*, 30*a*. The extension portions 28*b*, 30*b* are arranged between the electron emission regions 22, 22' on the extension portion 20*b*, and the additional insulating layer 28 is formed to be thicker than the electron emission regions 20, 22'.

Accordingly, a height ($h_3$) from a bottom surface of the cathode substrate 12 to a top surface of the control electrode 30 is set to be larger than a height ($h_4$) from the bottom surface of the cathode substrate 12 to a top surface of the electron emission regions 20, 22. A height ($h_5$) from the bottom surface of the cathode substrate 12 to a top surface of the gate electrode 16' can be adjusted variously, for example, higher or lower than the height ($h_4$), according to the voltage condition applied to the control electrode 30.

In addition, the gate electrode 16' arranged on the cathode substrate 12 of the second embodiment can be positioned to correspond to the center of a pixel area of the electron emission device 4.

According to the above described structure of the second embodiment, the electron emission device 4 exposes a second gate electrode (or a second gate electrode portion 16*b*) of a gate electrode 16' at a space between an electron emission portion 22 on a first extension portion 20*b* and an electron emission portion 22' on a second extension portion 20*b*, and control electrodes 30 are arranged on an outer (or a longitudinal outer side) portion of the electron emission regions 22, 22'. Accordingly, when electrons are emitted from the electron emission regions 22, 22' and induced to the phosphor layer 26*a*, they are induced to a path of the phosphor layer 26*a* by an electric field formed by the control electrode 30 and/or the gate electrode 16'. Therefore, the electron emission device 4 can also display the desired images with good quality while efficiently preventing spreading of the electron beam, and enhancing color representation.

Figure 4:
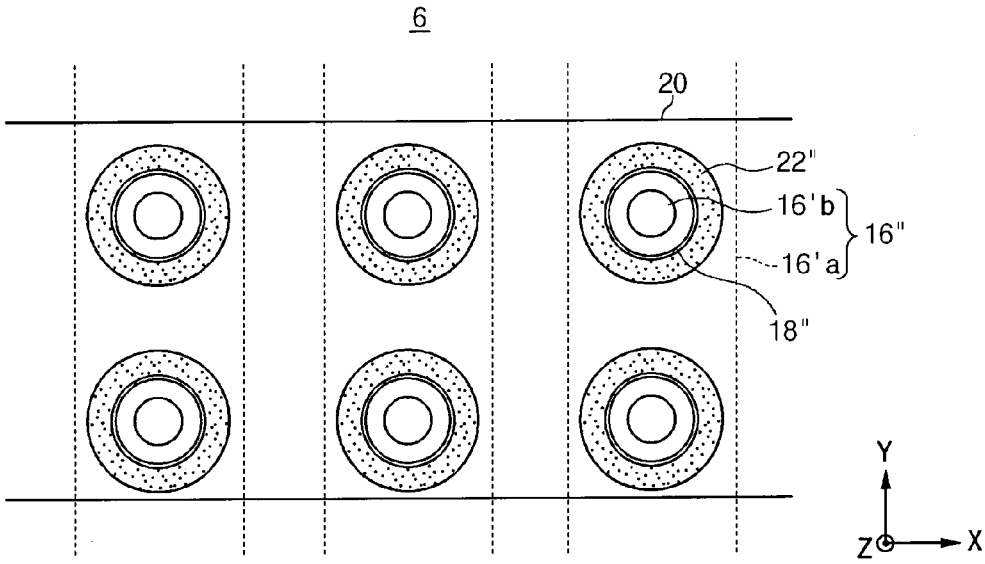
FIG. 4 is a partial plan view of an electron emission device according to a third embodiment of the present invention.
Figure 5:
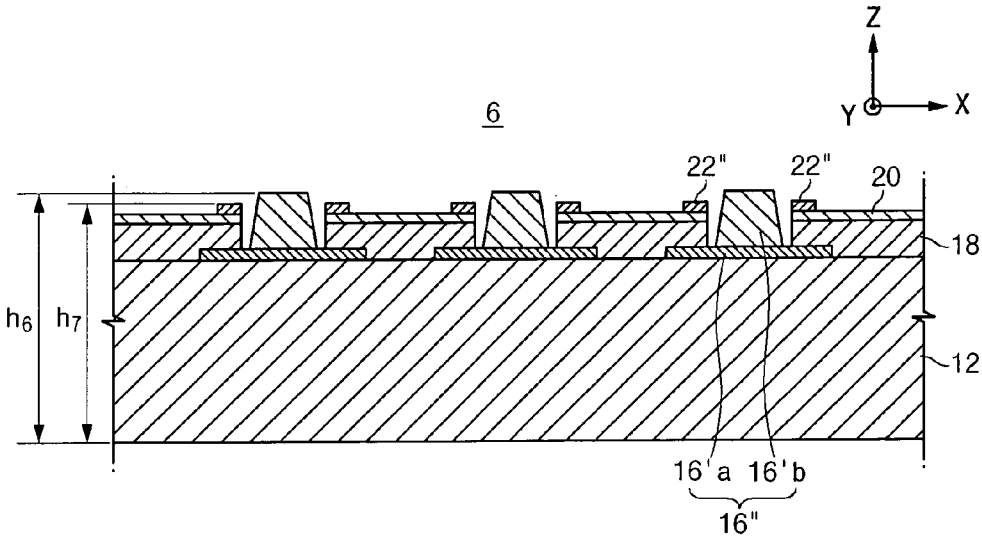
FIG. 5 is a partial cross-sectional view of the electron emission device according to FIG. 4, which is taken in a direction of an arrow Y of FIG. 4.

FIG. 4 and FIG. 5 are a partial plan view and a partial cross-sectional view of a cathode substrate of an electron emission device 6 according to a third embodiment of the present invention.

Certain differences of the electron emission device 6 of the third embodiment from the electron emission device 1 of the first embodiment described in FIG. 1 and FIG. 2 are such that an insulating layer hole 18" has a circular pattern rather than a linear pattern, and a gate electrode 16" includes a first gate electrode 16'*a* and a second gate electrode 16'*b*. The first gate electrode 16*a*' has a thin layer in a stripe pattern, and the second gate electrode 16'*b* has a thick layer in a dot (or circular) pattern. The thick layer of the second electrode 16'*b* is thicker than the thin layer of the first gate electrode 16'*a*. In addition, the electron emission device 6 has an electron emission region 22" formed in a ring pattern surrounding the second gate electrode 16'*b* of the gate electrode 16'.

A height ($h_6$) from a bottom surface of the cathode substrate 12 to a top surface of the gate electrode 16" is set to be larger than a height ($h_7$) from the bottom surface of the cathode substrate 12 to a top surface of the electron emission region 22".

Functions of the electron emission device 6 are substantially the same as the other electron emission devices 1, 4 described above.

The electron emission device 6 can also include a control electrode that is substantially the same as the control electrode 30 of the electron emission device 4 described in FIG. 3, which is not shown in FIG. 4 and FIG. 5.

In general, the shapes of the gate electrodes and/or the electron emission regions of the first, second, and third embodiments of the present invention are provided for exemplary purposes, and they can be varied without departing from the spirit and scope of the present invention.

As described above, an exemplary electron emission device of the present invention has a structure such that the exposed portion of a gate electrode which is exposed out of an insulating layer through a hole of the insulating layer is arranged on the center of a pixel area, and an electrode emission region is arranged around the exposed portion. Accordingly, the electrons emitted from the electron emission region can be deflected toward the center of the pixel by the electric field formed by the gate electrode, and thereby collide with the phosphor screen of the anode substrate. Therefore, the electron emission device can efficiently prevent spreading of the electron beam to thereby prevent emitting improper colors, and enhance color representation.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a cathode substrate and an anode substrate facing each other and separated from each other by a predetermined distance to form a vacuum vessel;

an electron emission unit disposed on the cathode substrate to emit electrons; and a light emission unit disposed on the anode substrate to emit light caused by the electrons for displaying desired images;

wherein the electron emission unit includes a gate electrode, a cathode electrode, and an electron emission region and wherein the gate electrode is arranged on the cathode substrate to correspond to the center of a pixel area of the electron emission device, the cathode electrode is arranged on an outer portion of the gate electrode and insulated from the gate electrode, and the electron emission region is arranged on the cathode electrode.

2. An electron emission device comprising:

a cathode substrate and an anode substrate facing each other;

a gate electrode arranged on the cathode substrate to correspond to the center of a pixel area of the electron emission device;

a cathode electrode arranged around the gate electrode and being symmetric with respect to the gate electrode; and an electron emission region arranged on the cathode electrode.

3. The electron emission device of claim 2, wherein the gate electrode and the cathode electrode are insulated by an insulating layer formed on the cathode substrate, and the cathode electrode is formed on the insulating layer.

4. An electron emission device comprising:

a cathode substrate and an anode substrate facing each other;

a gate electrode arranged on the cathode substrate;

a cathode electrode arranged around the gate electrode and being symmetric with respect to the gate electrode; and an electron emission region arranged on the cathode electrode, wherein the gate electrode and the cathode electrode are insulated by an insulating layer formed on the cathode substrate, and the cathode electrode is formed on the insulating layer, and wherein the insulating layer has an insulating layer hole exposing a part of the gate electrode.

5. The electron emission device of claim 4, wherein the insulating layer hole is formed in a linear pattern.

6. The electron emission device of claim 5, wherein the gate electrode has a single layer structure.

7. The electron emission device of claim 5, wherein the gate electrode has a multiple layer structure having two or more layers.

8. The electron emission device of claim 7, wherein the gate electrode includes a first gate electrode layer and a second gate electrode layer, wherein the second gate electrode layer is formed on the first gate electrode layer, and wherein the second gate electrode layer formed on the first gate electrode layer is thicker than the first gate electrode layer.

9. The electron emission device of claim 8, wherein the second gate electrode layer is formed in a linear pattern.

10. The electron emission device of claim 9, wherein a height from a bottom surface of the cathode substrate to a top surface of the gate electrode is larger than a height from the bottom surface of the cathode substrate to a top surface of the electron emission region.

11. The electron emission device of claim 9, further including a control electrode arranged on the cathode substrate surrounding the electron emission region.

12. The electron emission device of claim 11, wherein a height from a bottom surface of the cathode substrate to a top surface of the control electrode is larger than the height from the bottom surface of the cathode substrate to a top surface of the electron emission region.

13. The electron emission device of claim 4, wherein the insulating layer hole is formed in a circular pattern.

14. The electron emission device of claim 13, wherein the gate electrode has a multiple layer structure having two or more layers.

15. The electron emission device of claim 14, wherein the gate electrode includes a first gate electrode layer and a second gate electrode layer, wherein the second gate electrode layer is formed on the first gate electrode layer, and wherein the second gate electrode layer formed on the first gate electrode layer is thicker than the first gate electrode layer.

16. The electron emission device of claim 15, wherein the second gate electrode layer is formed in a circular pattern.

17. The electron emission device of claim 16, wherein the electron emission region is formed in a ring pattern surrounding the second gate electrode layer.

18. The electron emission device of claim 17, wherein a height from a bottom surface of the cathode substrate to a top surface of the gate electrode is larger than a height from the bottom surface of the cathode substrate to a top surface of the electron emission region.

19. An electron emission device comprising:

a cathode substrate and an anode substrate facing each other;

an insulating layer formed on the cathode substrate and having an insulating layer hole;

a cathode electrode formed on the insulating layer and having a portion arranged on a plane;

a gate electrode formed on the cathode substrate having a portion exposed through the insulating layer hole of the insulating layer and arranged on the plane of the cathode electrode, the gate electrode being insulated from the cathode electrode by the insulating layer; and an electron emission region formed on the cathode electrode.

20. An electron emission device comprising:

a cathode substrate and an anode substrate facing each other and separated from each other by a predetermined distance to form a vacuum vessel;

an electron emission unit disposed on the cathode substrate to emit electrons; and a light emission unit disposed on the anode substrate to emit light caused by the electrons for displaying desired images;

wherein the electron emission unit includes a gate electrode, a cathode electrode, and an electron emission region and wherein the gate electrode is arranged in an inner portion of the cathode electrode corresponding to the center of a pixel area of the electron emission device and insulated from the cathode electrode, and the electron emission region is arranged on the cathode electrode.

* * * * *